US010883263B1

(12) United States Patent
Fujisaki

(10) Patent No.: US 10,883,263 B1
(45) Date of Patent: Jan. 5, 2021

(54) REINFORCING STRUCTURE FOR WOODEN BUILDING

(71) Applicant: Sanao Fujisaki, Fukuoka (JP)

(72) Inventor: Sanao Fujisaki, Fukuoka (JP)

(73) Assignee: Keiko Tsuru, Fukuoka (JP)

( * ) Notice: Subject to any disclaimer, the term of this patent is extended or adjusted under 35 U.S.C. 154(b) by 0 days.

(21) Appl. No.: 17/012,048

(22) Filed: Sep. 4, 2020

(51) Int. Cl.
*E04B 1/26* (2006.01)
*E04H 9/02* (2006.01)
*E04B 1/19* (2006.01)
*E04B 1/24* (2006.01)

(52) U.S. Cl.
CPC ..... *E04B 1/26* (2013.01); *E04H 9/021* (2013.01); *E04B 2001/1993* (2013.01); *E04B 2001/2448* (2013.01)

(58) Field of Classification Search
CPC ..... E04B 1/26; E04B 2001/1993; E04B 2001/2448; E04H 9/02; E04H 9/021; E04H 9/0237
USPC ..... 52/23
See application file for complete search history.

(56) References Cited

U.S. PATENT DOCUMENTS 4,321,776 A * 3/1982 Delight ..... C30B 1/023 52/167.1
6,014,843 A * 1/2000 Crumley ..... E04H 9/02 403/300
10,280,963 B2 * 5/2019 Crumley ..... E04B 2/20
2001/0037611 A1 * 11/2001 Cornett, Sr. ..... E04B 7/02 52/23
2012/0180423 A1 * 7/2012 Avila ..... E04H 9/021 52/700
2013/0340366 A1 * 12/2013 Gray ..... E04B 1/26 52/223.14
2014/0090315 A1 * 4/2014 Imai ..... E04B 1/49 52/167.1
2016/0040446 A1 * 2/2016 Becci ..... E04B 1/38 52/167.1
2016/0076239 A1 * 3/2016 Espinosa ..... E04B 2/56 52/236.3
2017/0260742 A1 * 9/2017 Rotter ..... E04B 7/063
2018/0209134 A1 * 7/2018 Calderon Uriszar-Aldaca ..... E04H 9/021
2019/0345710 A1 * 11/2019 Espinosa ..... E04B 2/60
(Continued)

FOREIGN PATENT DOCUMENTS

JP 2019-178527 A 10/2019

*Primary Examiner* — Paola Agudelo
(74) *Attorney, Agent, or Firm* — Yokoi & Co., U.S.A.; Toshiyuki Yokoi

(57) ABSTRACT

A reinforcing structure for a wooden building, having: a first anchor bolt that is horizontally inserted into a concrete foundation of the wooden building and fixed to the concrete foundation by an adhesive agent; a second anchor bolt that is horizontally inserted into a wooden beam of the wooden building and fixed to the wooden beam by the adhesive agent; a reinforcing steel bar that is arranged between the first anchor bolt and the second anchor bolt; a first fixing member that connects and fixes the first anchor bolt and the reinforcing steel bar with each other so that the first anchor bolt and the reinforcing steel bar are orthogonal to each other; and a second fixing member that connects and fixes the second anchor bolt and the reinforcing steel bar with each other so that the second anchor bolt and the reinforcing steel bar are orthogonal to each other.

8 Claims, 13 Drawing Sheets

(56) References Cited

U.S. PATENT DOCUMENTS

2020/0248470 A1* 8/2020 Jeon ..... E04H 9/027

* cited by examiner

REINFORCING STRUCTURE FOR WOODEN BUILDING

CROSS-REFERENCES TO RELATED APPLICATIONS

This patent specification is based on Japanese utility model application, No. 2019-4773 filed on Dec. 16, 2019 in the Japan Patent Office, the entire contents of which are incorporated by reference herein.

BACKGROUND OF THE INVENTION

1. Field of the Invention

The present invention relates to a reinforcing structure for wooden building. In particular, the present invention relates to a reinforcing structure for wooden building built by a wooden framework method (Framing).

2. Description of the Related Art

In recent years, natural disasters such as tornado, hurricane and earthquake have been increasing. The need of the reinforcing structure for protecting the wooden building from the natural disasters is increasing in recent years.

For example, Japanese Patent Application Laid-Open No. 2019-178527 discloses the structure of reinforcing the wooden building by inserting a vibration control damper between the frame materials of the wooden building.

BRIEF SUMMARY OF THE INVENTION

In the structure disclosed in Japanese Patent Application Laid-Open No. 2019-178527, when strong force is applied to the screw for fixing the metal fittings, there is a possibility that the screw comes off and the metal fittings are removed. In addition, the above described structure is not suitable for a wooden framework method (Framing).

The present invention provides a reinforcing structure capable of being applied to the wooden framework method (Framing) and hardly removed from the wooden building even when strong force is applied.

The present invention is a reinforcing structure for a wooden building, the reinforcing structure having: a first anchor bolt that is horizontally inserted into a concrete foundation of the wooden building and fixed to the concrete foundation by an adhesive agent; a second anchor bolt that is horizontally inserted into a wooden beam of the wooden building and fixed to the wooden beam by the adhesive agent; a reinforcing steel bar that is arranged between the first anchor bolt and the second anchor bolt; a first fixing member that connects and fixes the first anchor bolt and the reinforcing steel bar with each other so that the first anchor bolt and the reinforcing steel bar are orthogonal to each other; and a second fixing member that connects and fixes the second anchor bolt and the reinforcing steel bar with each other so that the second anchor bolt and the reinforcing steel bar are orthogonal to each other.

In the present invention configured above, the first anchor bolt is horizontally inserted into the concrete foundation of the wooden building and fixed to the concrete foundation by the adhesive agent. In addition, the second anchor bolt is horizontally inserted into the wooden beam of the wooden building and fixed to the wooden beam by the adhesive agent. The reinforcing steel bar is arranged between the first anchor bolt and the second anchor bolt, the first fixing member connects and fixes the first anchor bolt and the reinforcing steel bar with each other in a state of being orthogonal to each other, and the second fixing member connects and fixes the second anchor bolt and the reinforcing steel bar with each other in a state of being orthogonal to each other.

In the wooden building, the concrete foundation is located below, the wall is located above the concrete foundation, and the wooden beam as a joist receiving member is located further above the wall. In such a structure, the first fixing member is fixed to the tip of the first anchor bolt protruded from the concrete foundation of the wooden building, and the lower end of the reinforcing steel bar is fixed via the first fixing member. The reinforcing steel bar is extended toward the wooden beam of the wooden building located above, and fixed to the second anchor bolt via the second fixing member. The second anchor bolt is arranged orthogonal to the reinforcing steel bar and horizontally inserted and fixed to the wooden beam of the wooden building.

Consequently, the concrete foundation of the wooden building and the wooden beam of the wooden building are fixed to each other by the reinforcing steel bar at the position separated from the wall by the projected length of the first anchor bolt and the second anchor bolt. Thus, the concrete foundation and the wooden beam are prevented from separating from each other.

In the reinforcing structure configured above, the anchor bolts are inserted into the foundation and the wooden beam of the wooden building in the horizontal direction and fixed by the adhesive agent. Since the anchor bolts are fixed by the adhesive agent, the anchor bolts are hardly removed from the wooden building even when strong force for horizontally pulling the anchor bolts is applied. In addition, two anchor bolts and the reinforcing steel bar are fixed with each other by the fixing member in a state that the two anchor bolts and the reinforcing steel bar are orthogonal to each other. Namely, the reinforcing steel bar is arranged parallel to the wall surface of the wooden building. Consequently, the force for pulling the foundation and the wooden beam to be separated from each other in the direction orthogonal to the anchor bolt can be absorbed by the reinforcing steel bar. Since the anchor bolts are horizontally arranged, the reinforcing steel bar can be arranged to be apart from the wall surface of the wooden building. Consequently, the reinforcing structure can be attached to various wooden buildings and workability for fixing the reinforcing steel bar can be ensured.

In the above described configuration, the first fixing member can include: a first vertical plate that is fixed to the first anchor bolt so that the first vertical plate is orthogonal to the axial direction of the first anchor bolt; and a first horizontal plate that is integrally formed with the first vertical plate or fixed to the first vertical plate so that the first horizontal plate is orthogonal to the first vertical plate, the second fixing member can include: a second vertical plate that is fixed to the second anchor bolt so that the second vertical plate is orthogonal to the axial direction of the second anchor bolt; and a second horizontal plate that is integrally formed with the second vertical plate or fixed to the second vertical plate so that the second horizontal plate is orthogonal to the second vertical plate, and the reinforcing steel bar is fixed to the first horizontal plate and the second horizontal plate.

In the reinforcing structure configured above, the anchor bolt and the reinforcing steel bar can be easily fixed to each other in a state of being orthogonal to each other by fixing the anchor bolt to the vertical plate and fixing the reinforcing steel bar to the horizontal plate.

In the above described configuration, the first fixing member and the concrete foundation can be separated from each other by a predetermined interval, and the second fixing member and the wooden beam can be separated from each other by the predetermined interval.

In the reinforcing structure configured above, since the predetermined interval is formed between the fixing member and the wooden building, workability for fixing the anchor bolt and the reinforcing steel bar to the fixing member can be ensured.

In the above described configuration, the first anchor bolt can be inserted into a first hole formed on the first vertical plate and fixed to the first vertical plate by a first nut, and the second anchor bolt can be inserted into a second hole formed on the second vertical plate and fixed to the second vertical plate by a second nut.

In the reinforcing structure configured above, since the anchor bolt is fixed to the fixing member by the nut, the anchor bolt and the fixing member can be firmly fixed with each other.

In the above described configuration, the first anchor bolt can be inserted into a first hole formed on the first vertical plate and fixed to the first vertical plate by welding, and the second anchor bolt can be inserted into a second hole formed on the second vertical plate and fixed to the second vertical plate by welding.

In the reinforcing structure configured above, since the anchor bolt is fixed to the fixing member by welding, the anchor bolt and the fixing member can be firmly fixed with each other without using the nut.

In the above described configuration, the reinforcing steel bar can be inserted into a first hole formed on the first horizontal plate and fixed to the first horizontal plate by a first nut, and the reinforcing steel bar can be inserted into a second hole formed on the second horizontal plate and fixed to the second horizontal plate by a second nut.

In the reinforcing structure configured above, since the reinforcing steel bar is fixed to the fixing member by the nut, the reinforcing steel bar and the fixing member can be firmly fixed with each other.

In the above described configuration, the reinforcing steel bar can be screwed to a first thread formed in a first hole formed on the first horizontal plate and fixed to the first horizontal plate, and the reinforcing steel bar can be screwed to a second thread formed in a second hole formed on the second horizontal plate and fixed to the second horizontal plate.

In the reinforcing structure configured above, since the reinforcing steel bar is screwed to the thread formed in the hole formed on the horizontal plate, the reinforcing steel bar and the fixing member can be firmly fixed with each other without using the nut.

In the above described configuration, the second anchor bolt can be fixed to the wooden beam of a joist receiving member of the wooden building.

In the reinforcing structure configured above, the force applied in the direction of pulling the foundation and the joist receiving member of the wooden beam of the wooden building from each other can be absorbed by the reinforcing steel bar.

The present invention can provide a reinforcing structure capable of being applied to the wooden framework method (Framing), capable of absorbing the force of pulling the foundation and the wooden beam of the wooden building to be separated from each other, and hardly removed from the wooden building even when strong force is applied.

DETAILED DESCRIPTION OF THE INVENTION

Hereafter, embodiments of the present invention will be explained with reference to the drawings shown as an example.

Figure 1:
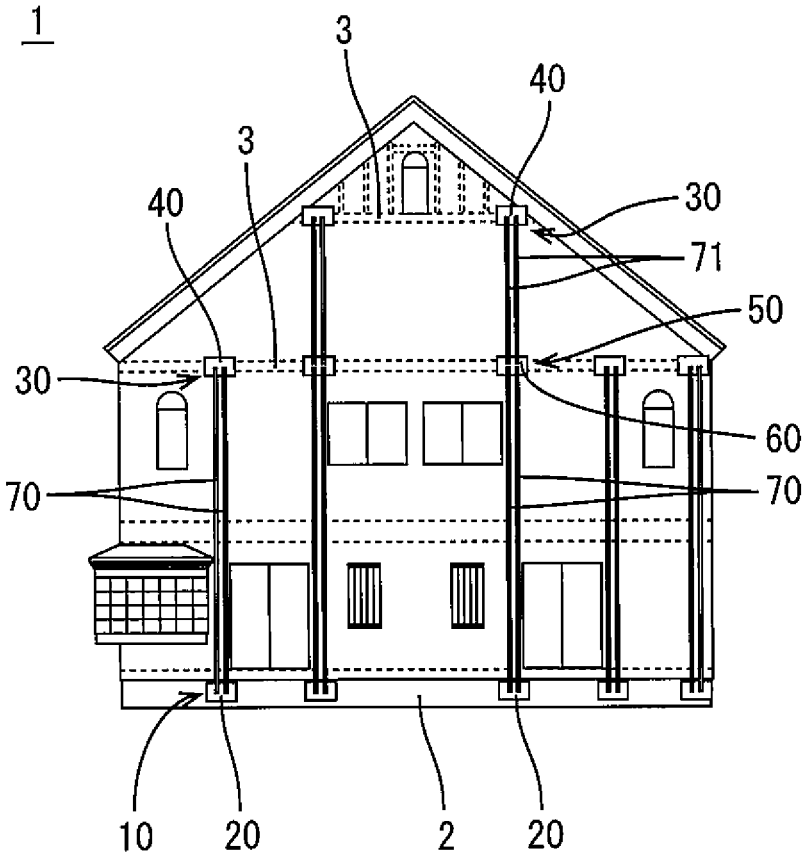
FIG. 1 is a drawing showing a state that a reinforcing structure of the present invention is attached to the front part of a wooden building.
Figure 2:
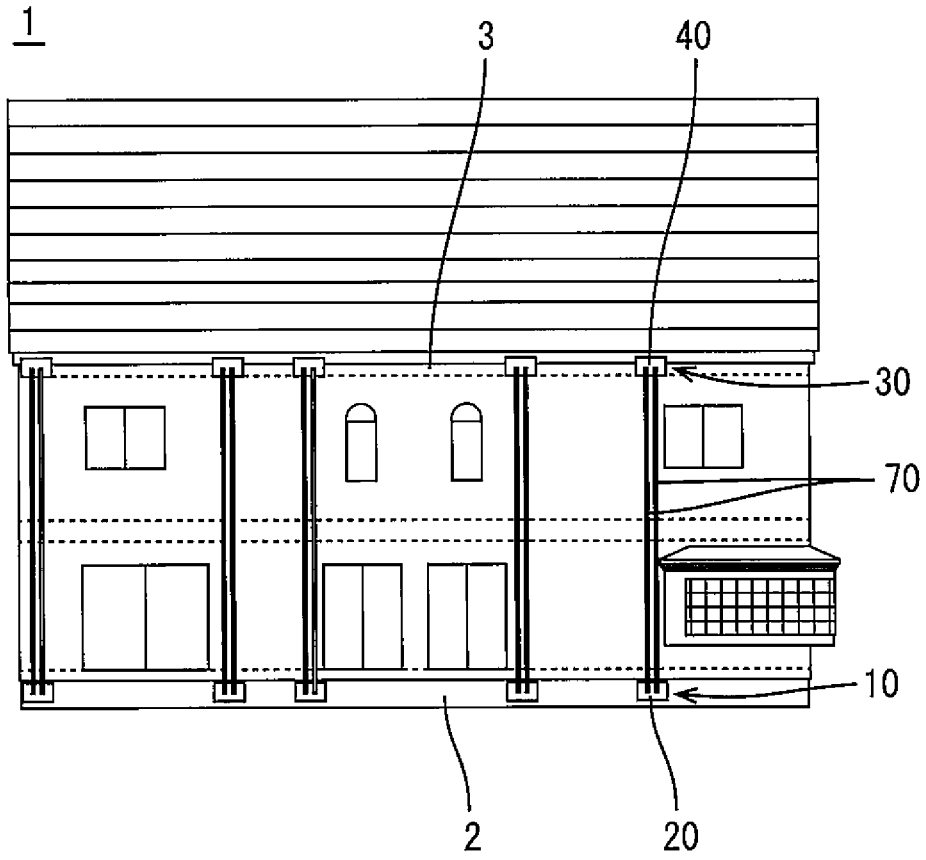
FIG. 2 is a drawing showing a state that the reinforcing structure of the present invention is attached to side part of the wooden building.

FIGS. 1 and 2 are drawings showing a state that the reinforcing structure of the present invention is attached to a wooden building 1. The reinforcing structure of the present invention is composed of anchor bolts 10, 30, 50 fixed to a foundation 2 or a wooden beam 3 of the wooden building 1, reinforcing steel bars (reinforcing bars, rebars) 70, 71 arranged between the anchor bolts 10, 30, 50, and fixing members 20, 40, 60 for fixing the anchor bolts 10, 30, 50 and the reinforcing steel bars 70, 71 with each other. Hereafter, the anchor bolt fixed to the foundation 2 is referred to as a first anchor bolt 10, and the fixing member for fixing the first anchor bolt 10 with the reinforcing steel bar 70 is referred to as a first fixing member 20. On the other hand, the anchor bolt fixed to the wooden beam 3 is referred to as second anchor bolts 30, 50, and the fixing member for fixing the second anchor bolts 30, 50 with the reinforcing steel bars 70, 71 are referred to as second fixing members 40, 60.

When the wooden building 1 is reinforced at two vertical points of the foundation 2 and the wooden beam 3, as shown in the left part and right part of FIG. 1, the first anchor bolt 10 and the first fixing member 20 fixed to the foundation 2 and the second anchor bolt 30 and the second fixing member 40 fixed to the wooden beam 3 are used. On the other hand, when the wooden building 1 is reinforced at three vertical points, as shown in the center part of FIG. 1, the first anchor bolt 10 and the first fixing member 20 fixed to the foundation 2 and the second anchor bolts 30, 50 and the second fixing members 40, 60 fixed to the wooden beam are used. In this case, both the reinforcing steel bar 70 extending downward and the reinforcing steel bar 71 extending upward are fixed to the second fixing member 60 which is located at the intermediate portion.

Figure 3:
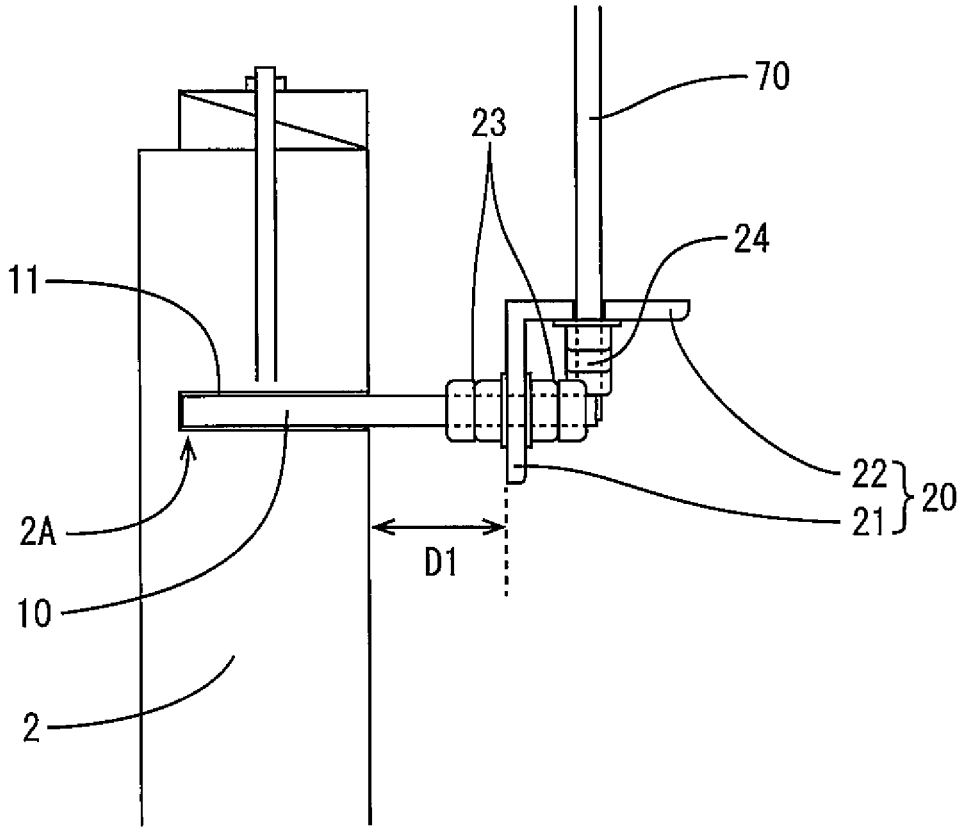
FIG. 3 is a side view showing a state that an anchor bolt and a fixing member are fixed to a foundation of the wooden building.
Figure 4:
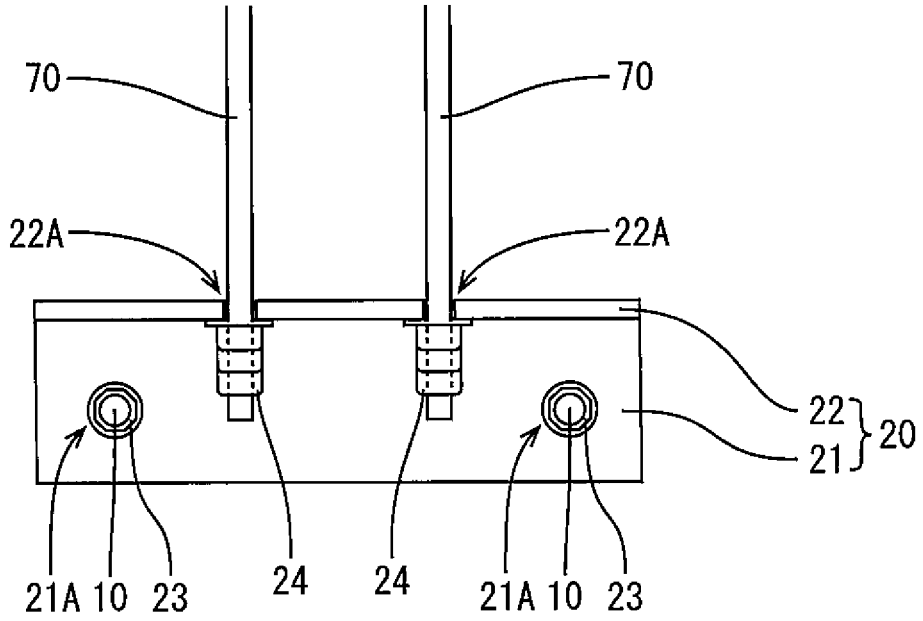
FIG. 4 is a front view showing a state that the anchor bolt and the fixing member are fixed to the foundation of the wooden building.

FIGS. 3 and 4 show a state that the first anchor bolt 10 and the first fixing member 20 are fixed to the foundation 2 of the wooden building 1. A horizontally extending bolt hole 2A is formed on the foundation 2 made of concrete (hereafter, referred to as a concrete foundation) of the wooden building 1 by using a drill or the like. The bolt hole 2A is a hole formed in a circular cross section having an outer diameter of 24 mm and a depth of 120 mm. The first anchor bolt 10 is formed in a liner shape having a diameter of 20 mm and an entire length of 250 mm. Since the depth of the bolt hole 2A is shorter than the entire length of the first anchor bolt 10, the first anchor bolt 10 is protruded from the surface of the foundation 2 by a predetermined length in a state that the first anchor bolt 10 is inserted to the innermost of the bolt hole 2A. In the present embodiment, the predetermined length is 130 mm (250 mm-120 mm). The first anchor bolt 10 is horizontally inserted into the bolt hole 2A and arranged orthogonal (perpendicular) to the wall surface of the wooden building 1. An adhesive agent 11 is inserted between the first anchor bolt 10 and the bolt hole 2A. Thus, the first anchor bolt 10 is firmly fixed to the foundation 2 by the adhesive agent 11. For the adhesive agent 11, HIT-RE 500 V3 (epoxy resin mortar) manufactured by Hilti Corporation is used. The first anchor bolt 10 is fixed to the foundation 2 at one end, and fixed to the later described first fixing member 20 at the other end.

A thread is formed on an outer periphery of the other end of the first anchor bolt 10 so that the thread is screwed with a nut 23.

The first fixing member 20 is an angle steel having a length of 120 mm×120 mm and a thickness of 10 mm. The first fixing member 20 is folded to make a right angle (90°) at an approximately center portion, and is L-shaped in cross section when viewed from a lateral side. Namely, the first fixing member 20 is composed of a first vertical plate 21 which is arranged in the vertical direction and a first horizontal plate 22 which is formed integrally with the first vertical plate 21 so as to be arranged in the horizontal direction. A first hole 21A having a circular shape is formed on the first vertical plate 21 to insert the first anchor bolt 10 into the first hole 21A. A second hole 22A having a circular shape is formed on the first horizontal plate 22 to insert the reinforcing steel bar 70 into the second hole 22A. In a state that the first anchor bolt 10 is inserted into and passed through the first hole 21A, the nut 23 can be tightened to the first anchor bolt 10 from both sides of the first vertical plate 21. Consequently, the first anchor bolt 10 is fixed to the first vertical plate 21. A double nut is used for the nut 23. Namely, two nuts are tightened to each side of the first vertical plate 21, and totally four bolts are tightened from both sides of the first vertical plate 21.

In a state that the first anchor bolt 10 and the first fixing member 20 are fixed with each other, the first vertical plate 21 is arranged orthogonal to the axial direction of the first anchor bolt 10 (i.e., parallel to the wall of the wooden building 1), and the first horizontal plate 22 is arranged orthogonal to the first vertical plate 21 (i.e., perpendicular to the wall of the wooden building 1). Namely, the first horizontal plate 22 is arranged to extend in the axial direction of the first anchor bolt 10. Accordingly, the first vertical plate 21 and the first horizontal plate 22 are arranged to be orthogonal to each other. In a state that the first anchor bolt 10 and the first fixing member 20 are fixed with each other, the first vertical plate 21 and the foundation 2 are separated (apart) from each other by a predetermined interval D1. The predetermined interval D1 is preferably 10 mm to 12 mm. In the present embodiment, two first holes 21A are horizontally formed on the first vertical plate 21 and two first anchor bolts 10 are fixed to one first fixing member 20. Namely, two first anchor bolts 10 are fixed to the foundation 2 in a state that two first anchor bolts 10 are horizontally arranged.

The reinforcing steel bar 70 is formed in a linear shape having a diameter of 22 mm. The length of the reinforcing steel bar 70 can be arbitrarily specified depending on the distance between the first fixing member 20 and the second fixing member 40. A thread is formed on an outer periphery of the lower end portion of the reinforcing steel bar 70 so that the thread is screwed with a nut 24. In a state that the reinforcing steel bar 70 is inserted into and passed through the second hole 22A from the above, the nut 24 can be tightened to the reinforcing steel bar 70 from the lower side of the first horizontal plate 22. Consequently, the reinforcing steel bar 70 is fixed to the first horizontal plate 22. A triple nut is used for the nut 24. Namely, three nuts are tightened to the reinforcing steel bar 70. Since the first vertical plate 21 and the first horizontal plate 22 are arranged to be orthogonal to each other, when the first anchor bolt 10 is fixed to the first vertical plate 21 and the reinforcing steel bar 70 is fixed to the first horizontal plate 22, the first anchor bolt 10 and the reinforcing steel bar 70 are arranged to be orthogonal to each other. Namely, the first fixing member 20 can be referred to as a member that connects and fixes the first anchor bolt 10 and the reinforcing steel bar 70 with each other so that the first anchor bolt 10 and the reinforcing steel bar 70 are orthogonal to each other. In the present embodiment, two second holes 22A are horizontally formed on the first horizontal plate 22 and two parallelly arranged reinforcing steel bars 70 are fixed to one first fixing member 20.

Since the first anchor bolt 10 is horizontally arranged on the foundation 2 of the wooden building 1, the reinforcing steel bar 70 can be arranged so as to be separated from the wall surface of the wooden building 1. Consequently, the reinforcing structure can be attached to various wooden buildings and the workability of fixing the reinforcing steel bar 70 can be ensured. Since the first anchor bolt 10 is fixed to the foundation 2 by the adhesive agent 11, the first anchor bolt 10 is hardly removed from the foundation 2 even when strong force is applied in the direction of pulling the first anchor bolt 10 from the foundation 2.

Since the first fixing member 20 is L-shaped in cross section, the first fixing member 20 can fix the first anchor bolt 10 and the reinforcing steel bar 70 with each other in a state that the first anchor bolt 10 and the reinforcing steel bar 70 are orthogonal to each other. Namely, the first anchor bolt 10 is fixed orthogonal to the wall, and the reinforcing steel bar 70 is fixed parallel to the wall. In addition, since the first fixing member 20 is composed of the first vertical plate 21 and the first horizontal plate 22 which are orthogonal to each other, the first anchor bolt 10 and the reinforcing steel bar 70 can be fixed with each other in a state of being orthogonal to each other only by fixing the first anchor bolt 10 to the first vertical plate 21 and fixing the reinforcing steel bar 70 to the first horizontal plate 22.

The first anchor bolt 10 is inserted into the first hole 21A formed on the first vertical plate 21 of the first fixing member 20 and fixed to the first fixing member 20 by the nut 23. Consequently, the first anchor bolt 10 and the first fixing member 20 can be firmly fixed to each other. The reinforcing steel bar 70 is inserted into the second hole 22A formed on the first horizontal plate 22 of the first fixing member 20 and fixed to the first fixing member 20 by the nut 24. Consequently, the reinforcing steel bar 70 and the first fixing member 20 can be firmly fixed to each other. As explained above, the first anchor bolt 10 and the reinforcing steel bar 70 can be firmly fixed to each other via the first fixing member 20.

Figure 5:
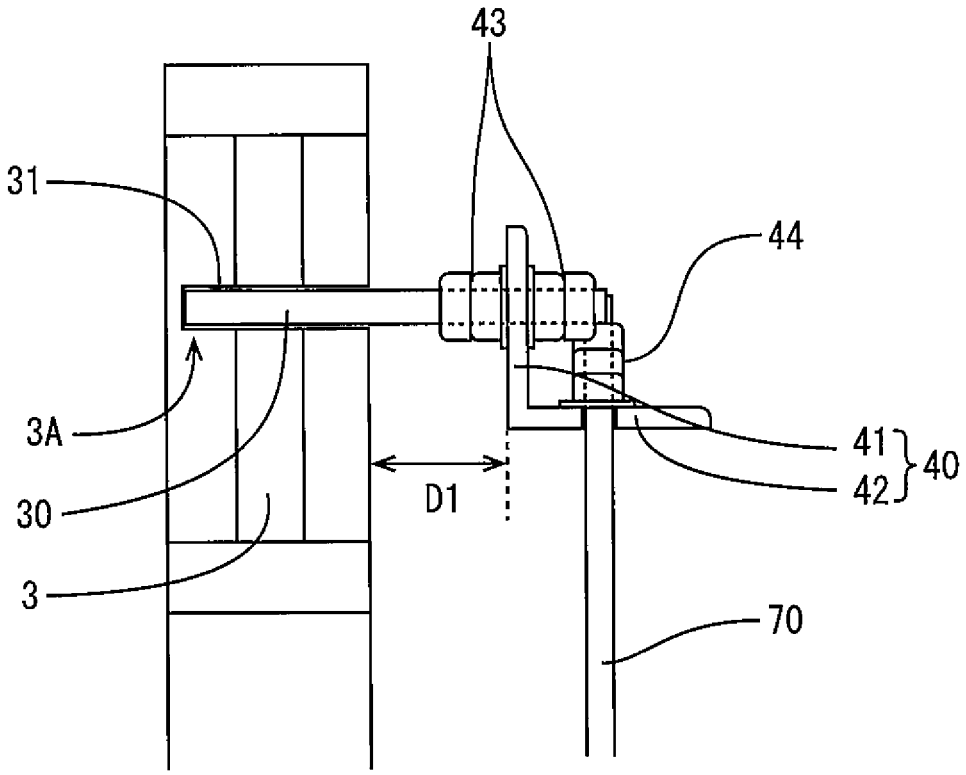
FIG. 5 is a side view showing a state that an anchor bolt and a fixing member are fixed to a wooden beam of the wooden building.
Figure 6:
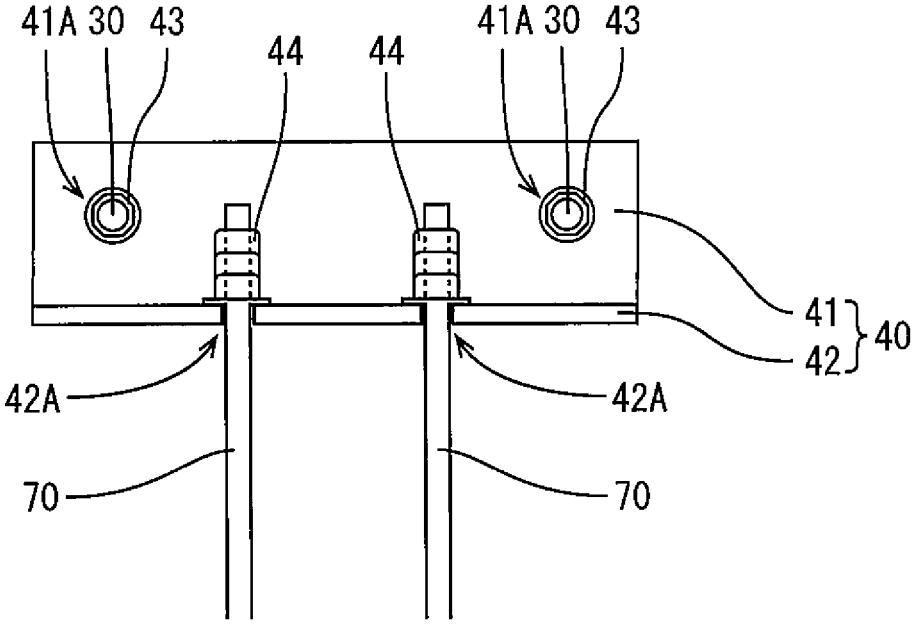
FIG. 6 is a front view showing a state that the anchor bolt and the fixing member are fixed to the wooden beam of the wooden building.

FIGS. 5 and 6 show a state that the second anchor bolt 30 and the second fixing member 40 are fixed to the wooden beam 3 of the wooden building 1. A horizontally extending bolt hole 3A is formed on the wooden beam 3 of a joist receiving member (frame material made of wood) of the wooden building 1 by using a drill or the like. The bolt hole 3A is a hole formed in a circular cross section having an outer diameter of 24 mm and a depth of 120 mm. The second anchor bolt 30 is same as the first anchor bolt 10. Since the depth of the bolt hole 3A is shorter than the entire length of the second anchor bolt 30, the second anchor bolt 30 is protruded from the surface of the wooden beam 3 by the predetermined length in a state that the second anchor bolt 30 is inserted to the innermost of the bolt hole 3A. In the present embodiment, the predetermined length is 130 mm (250 mm-120 mm). The second anchor bolt 30 is horizontally inserted into the bolt hole 3A and arranged orthogonal (perpendicular) to the wall surface of the wooden building 1. An adhesive agent 31 is inserted between the second anchor bolt 30 and the bolt hole 3A. Thus, the second anchor bolt 30 is firmly fixed to the wooden beam 3 by the adhesive agent 31. Same adhesive agent as the adhesive agent 11 is used for the adhesive agent 31. The second anchor bolt 30 is fixed to the wooden beam 3 at one end, and fixed to the later described second fixing member 40 at the other end. A thread is formed on an outer periphery of the other end of the second anchor bolt 30 so that the thread is screwed with a nut 43.

The first fixing member 40 is an angle steel having a length of 120 mm×120 mm and a thickness of 10 mm. The second fixing member 40 is folded to make a right angle) (90°) at an approximately center portion, and is L-shaped in cross section when viewed from a lateral side. Namely, the second fixing member 40 is composed of a second vertical plate 41 which is arranged in the vertical direction and a second horizontal plate 42 which is formed integrally with the second vertical plate 41 so as to be arranged in the horizontal direction. A first hole 41A having a circular shape is formed on the second vertical plate 41 to insert the second anchor bolt 30 into the first hole 41A. A second hole 42A having a circular shape is formed on the second horizontal plate 42 to insert the reinforcing steel bar 70 into the second hole 42A. In a state that the second anchor bolt 30 is inserted into and passed through the first hole 41A, the nuts 43 can be tightened to the second anchor bolt 30 from both sides of the second vertical plate 41. Consequently, the second anchor bolt 30 is fixed to the second vertical plate 41. A double nut is used for the nut 43. Namely, two nuts are tightened to each side of the first vertical plate 41, and totally four bolts are tightened from both sides of the first vertical plate 41.

In a state that the second anchor bolt 30 and second fixing member 40 are fixed with each other, the second vertical plate 41 is arranged orthogonal to the axial direction of the second anchor bolt 30 (i.e., parallel to the wall of the wooden building 1), and the second horizontal plate 42 is arranged orthogonal to the second vertical plate 41 (i.e., perpendicular to the wall of the wooden building 1). Namely, the second horizontal plate 42 is arranged to extend in the axial direction of the second anchor bolt 30. Accordingly, the second vertical plate 41 and the second horizontal plate 42 are arranged to be orthogonal to each other. In a state that the second anchor bolt 30 and the second fixing member 40 are fixed with each other, the second vertical plate 41 and the wooden beam 3 are separated from each other by the predetermined interval D1. The predetermined interval D1 is same as the above described predetermined interval D1 between the first vertical plate 21 and the foundation 2. In the present embodiment, two first holes 41A are horizontally formed on the second vertical plate 41 and two second anchor bolts 30 are fixed to one second fixing member 40. Namely, two second anchor bolts 30 are fixed to the wooden beam 3 in a state that two second anchor bolts 30 are horizontally arranged.

A thread is formed on an outer periphery of the upper end portion of the reinforcing steel bar 70 so that the thread is screwed with a nut 44. In a state that the reinforcing steel bar 70 is inserted into and passed through the second hole 42A from the below, the nut 44 is tightened to the reinforcing steel bar 70 from the upper side of the second horizontal plate 42. A triple nut is used for the nut 44. Namely, three nuts are tightened to the reinforcing steel bar 70. Consequently, the reinforcing steel bar 70 is fixed to the second horizontal plate 42. Since the second vertical plate 41 and the second horizontal plate 42 are arranged to be orthogonal to each other, when the second anchor bolt 30 is fixed to the second vertical plate 41 and the reinforcing steel bar 70 is fixed the second horizontal plate 42, the second anchor bolt 30 and the reinforcing steel bar 70 are arranged to be orthogonal to each other. Namely, the second fixing member 40 can be referred to as a member that connects and fixes the second anchor bolt 30 and the reinforcing steel bar 70 with each other so that the second anchor bolt 30 and the reinforcing steel bar 70 are orthogonal to each other. In the present embodiment, two second holes 42A are horizontally formed on the second horizontal plate 42 and two parallelly arranged reinforcing steel bars 70 are fixed to one second fixing member 40.

Same as the first anchor bolt 10, since the second anchor bolt 30 is horizontally arranged on the wooden beam 3 of the wooden building 1, the reinforcing steel bar 70 can be arranged so as to be separated from the wall surface of the wooden building 1. In addition, since the second anchor bolt 30 is fixed to the wooden beam 3 by the adhesive agent 31, the second anchor bolt 30 is hardly removed from the wooden beam 3 even when strong force is applied in the direction of pulling the second anchor bolt 30 from the wooden beam 3.

Since the first fixing member 40 is L-shaped in cross section, the first fixing member 40 can fix the second anchor bolt 30 and the reinforcing steel bar 70 with each other in a state that the second anchor bolt 30 and the reinforcing steel bar 70 are orthogonal to each other. Namely, the second anchor bolt 30 is fixed orthogonal to the wall, and the reinforcing steel bar 70 is fixed parallel to the wall. In addition, since the second fixing member 40 is composed of the second vertical plate 41 and the second horizontal plate 42 which are orthogonal to each other, the second anchor bolt 30 and the reinforcing steel bar 70 can be fixed with each other in a state of being orthogonal to each other only by fixing the second anchor bolt 30 to the second vertical plate 41 and fixing the reinforcing steel bar 70 to the second horizontal plate 42.

The second anchor bolt 30 is inserted into the first hole 41A formed on the second vertical plate 41 of the second fixing member 40 and fixed to the second fixing member 40 by the nut 43. Consequently, the second anchor bolt 30 and the second fixing member 40 can be firmly fixed to each other. The reinforcing steel bar 70 is inserted into the second hole 42A formed on the second horizontal plate 42 of the second fixing member 40 and fixed to the second fixing member 40 by the nut 44. Consequently, the reinforcing steel bar 70 and second fixing member 40 can be firmly fixed to each other. As explained above, the second anchor bolt 30 and the reinforcing steel bar 70 can be firmly fixed to each other via the second fixing member 40.

The foundation 2 and the wooden beam 3 of the wooden building 1 are connected with each other via the first anchor bolt 10, the first fixing member 20, the reinforcing steel bar 70, the second fixing member 40 and the second anchor bolt 30. Consequently, when the force is applied in the direction of separating the foundation 2 and the wooden beam 3 of the wooden building 1 from each other, the force is transmitted from the first anchor bolt 10 to the reinforcing steel bar 70 via the first fixing member 20 and the force is also transferred from the second anchor bolt 30 to the reinforcing steel bar 70 via the second fixing member 40. Thus, the force applied in the direction of separating the foundation 2 and the wooden beam 3 from each other can be absorbed by the reinforcing steel bar 70. Accordingly, the foundation 2 and the wooden beam 3 are prevented from being separated from each other and the wooden building 1 is prevented from being collapsed. Since the reinforcing steel bar 70 has high tensile strength, the tensile strength of the wooden building 1 in the vertical direction can be increased remarkably. In addition, since the reinforcing steel bar 70 is fixed between the first fixing member 20 and the second fixing member 40, even when the distance between the foundation 2 and the wooden beam 3 of the wooden building 1 to be reinforced widely varies, the reinforcing structure of the present invention can be applied only by changing the length of the reinforcing steel bar 70 without changing other components.

Normally, all components of the building including the roof are pressed downward. Accordingly, the compression force is applied in the direction of bringing the upper/lower components 1 close to each other. The structural body of the building maintains the building while enduring the compression force. On the other hand, when the weather phenomenon such as tornado happens, the building is lifted upward. Although the building can endure the compression force, the building does not have enough strength against the reverse force (i.e., separating force). In the present embodiment, the concrete foundation located below and the wooden beam located above are connected with each other via the reinforcing steel bar so as not to be separated. Thus, the building can have enough strength to the reverse force (i.e., separating force). It is also possible to directly connect the concrete foundation located below and the wooden beam located above in the vertical direction to prevent them from being separated from each other. However, to achieve such a configuration, it is necessary to add the configuration when the building is newly built. Such configuration cannot be added to the already built building. In addition, if the plate material is directly attached along the wall surface, the strength is not enough and the plate material cannot be attached depending on the shape of the building.

Figure 7:
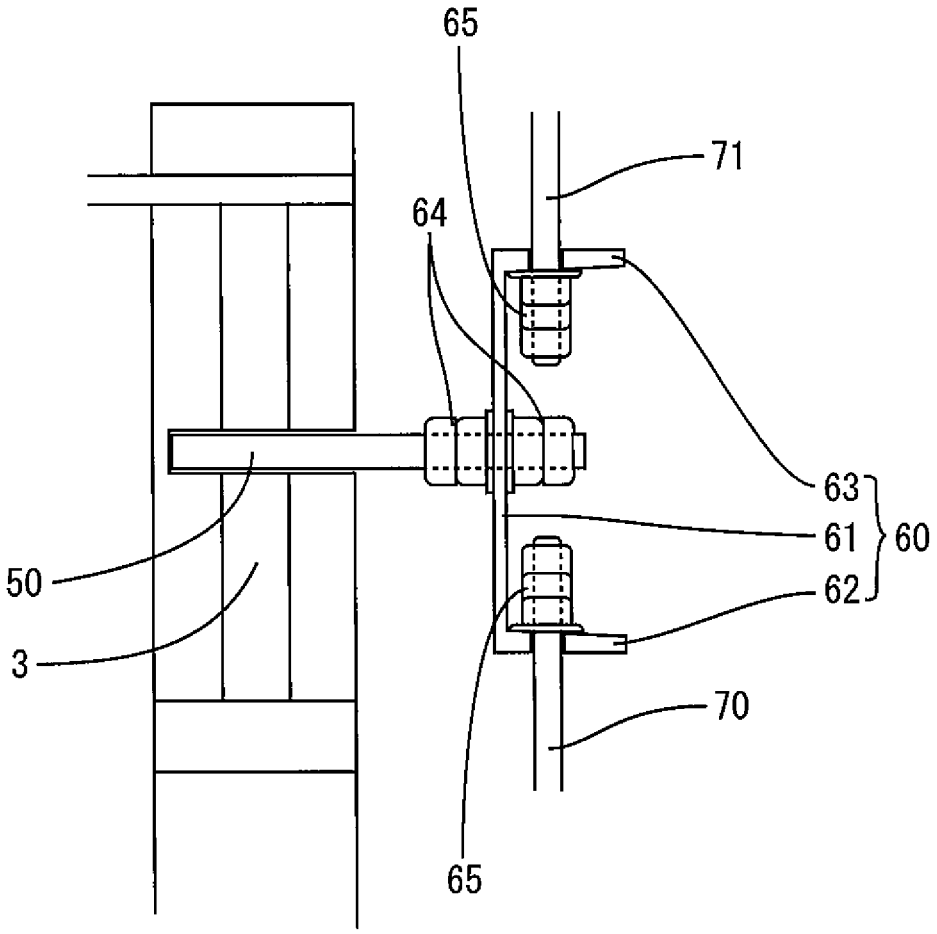
FIG. 7 is a side view showing a state that an anchor bolt and a fixing member are fixed to a wooden beam located at an intermediate portion of the wooden building.
Figure 8:
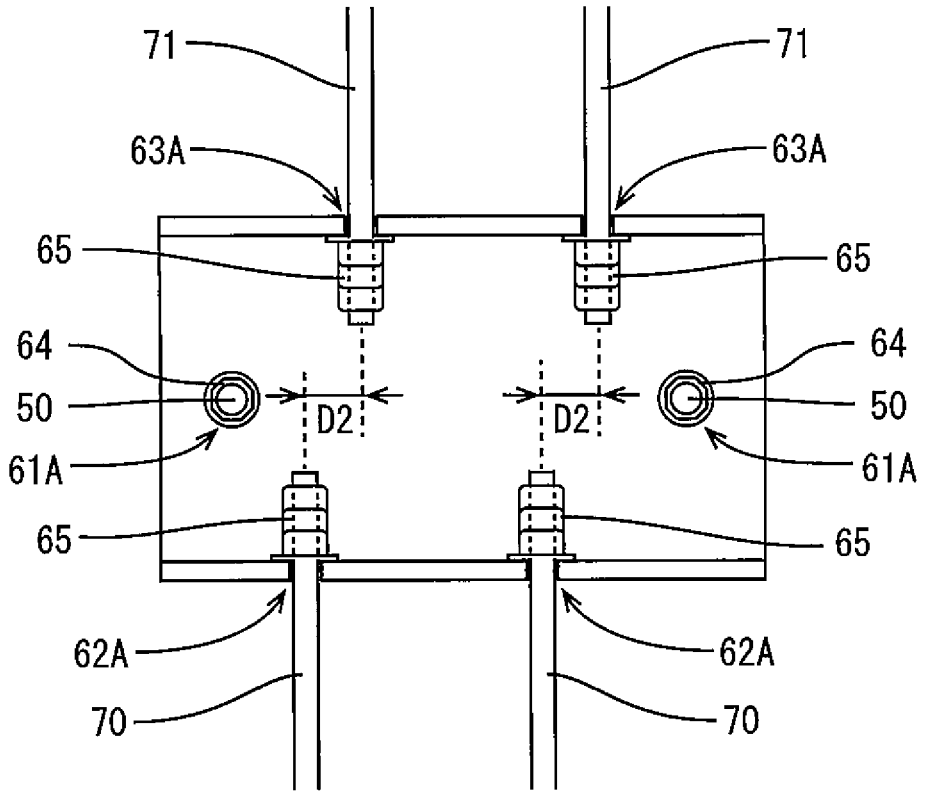
FIG. 8 is a front view showing a state that the anchor bolt and the fixing member are fixed to the wooden beam located at the intermediate portion of the wooden building.

FIGS. 7 and 8 show a state that the second anchor bolt 50 and the second fixing member 60 are fixed to the wooden beam of a joist receiving member (frame material) located at an intermediate portion when the wooden building 1 is reinforced at three vertical positions. The second anchor bolt 50 is same as the second anchor bolt 30, and the method to be fixed to the wooden beam 3 is also same. Thus, the explanation of the second anchor bolt 50 is omitted.

The second fixing member 60 is a channel steel having a length of 90 mm×250 mm×90 mm and a thickness of 9×13 mm. The second fixing member 60 is folded to make a right angle (90°) twice, and is U-shaped in cross section when viewed from a lateral side. Namely, the second fixing member 60 is composed of a second vertical plate 61 which is arranged in the vertical direction and two second horizontal plates 62, 63 which are arranged in the horizontal direction. A first hole 61A having a circular shape is formed on the second vertical plate 61 to insert the second anchor bolt 50 into the first hole 61A. The method of fixing the second anchor bolt 50 to the first hole 61A by using a nut 64 is same as the method of fixing the second anchor bolt 30 to the first hole 41A. Thus, the explanation is omitted. A second hole 62A having a circular shape is formed on the second horizontal plate 62 to insert the reinforcing steel bar 70 which extends in the lower direction into the second hole 62A. A second hole 63A having a circular shape is formed on the second horizontal plate 63 to insert the reinforcing steel bar 71 which extends in the upper direction into the second hole 63A.

In a state that the second anchor bolt 50 and second fixing member 60 are fixed with each other, the second vertical plate 61 is arranged orthogonal to the axial direction of the second anchor bolt 50 (i.e., parallel to the wall of the wooden building 1), the second horizontal plate 62 is integrally formed with the second vertical plate 61 so as to extend from the lower end portion of the second vertical plate 61, and the second horizontal plate 63 is integrally formed with the second vertical plate 61 so as to extend from the upper end portion of the second vertical plate 61. The second horizontal plates 62 and 63 are arranged orthogonal to the second vertical plate 61 (i.e., perpendicular to the wall of the wooden building 1). Namely, the second horizontal plate 62 is arranged to extend in the axial direction of the second anchor bolt 50 from the lower end portion of the second vertical plate 61, and the second horizontal plate 63 is arranged to extend in the axial direction of the second anchor bolt 50 from the upper end portion of the second vertical plate 61. Accordingly, the second vertical plate 61 and each of the second horizontal plates 62, 63 are arranged to be orthogonal to each other.

In a state that the reinforcing steel bar 70 is inserted into and passed through the second hole 62A from the below, a nut 65 is tightened to the reinforcing steel bar 70 from the upper side of the second horizontal plate 62. Consequently, the reinforcing steel bar 70 is fixed to the second horizontal plate 62. The reinforcing steel bar 71 is a reinforcing steel bar having the same specification as the reinforcing steel bar 70. Threads are formed on an outer periphery of the upper end portion and the lower end portion of the reinforcing steel bar 71 so that the threads are screwed with the nut 65. In a state that the reinforcing steel bar 71 is inserted into and passed through the second hole 63A from the above, the nut 65 is tightened to the reinforcing steel bar 71 from the lower side of the second horizontal plate 63. Consequently, the reinforcing steel bar 71 is fixed to the second horizontal plate 63. A triple nut is used for the nut 65. Namely, three nuts are tightened to the reinforcing steel bar 70 and the reinforcing steel bar 71. Since the second vertical plate 61 and the second horizontal plate 62 are arranged to be orthogonal to each other, when the second anchor bolt 50 is fixed to the second vertical plate 61 and the lower reinforcing steel bar 70 is fixed the second horizontal plate 62, the second anchor bolt 50 and the lower reinforcing steel bar 70 are arranged to be orthogonal to each other. In addition, since the second vertical plate 61 and the second horizontal plate 63 are arranged to be orthogonal to each other, when the second anchor bolt 50 is fixed to the second vertical plate 61 and the upper reinforcing steel bar 71 is fixed the second horizontal plate 63, the second anchor bolt 50 and the upper reinforcing steel bar 71 are arranged to be orthogonal to each other. Namely, when the second fixing member 60 is used, two reinforcing steel bars 70 and 71 can be fixed to the second fixing member 60 at the lower side and the upper side so as to be orthogonal to the anchor bolts. As shown in FIG. 8, the axial direction of the reinforcing steel bar 70 and the axial direction of the reinforcing steel bar 71 are displaced with each other by a predetermined distance D2.

When the wooden building 1 is reinforced by connecting three vertical positions, the second fixing member 40 formed in L-shaped in cross section can connect only two positions. Thus, two second anchor bolts 30 and two second fixing member 40 should be installed at the intermediate position to connect three vertical positions. However, when the second fixing member 60 formed in U-shaped in cross section is arranged at the intermediate position, the reinforcing steel bar 70 extending from the below and the reinforcing steel bar 71 extending from the above can be connected by one second fixing member 60. Accordingly, when the wooden building 1 is reinforced at three vertical positions, the number of the anchor bolts and the fixing members can be reduced.

Figure 9:
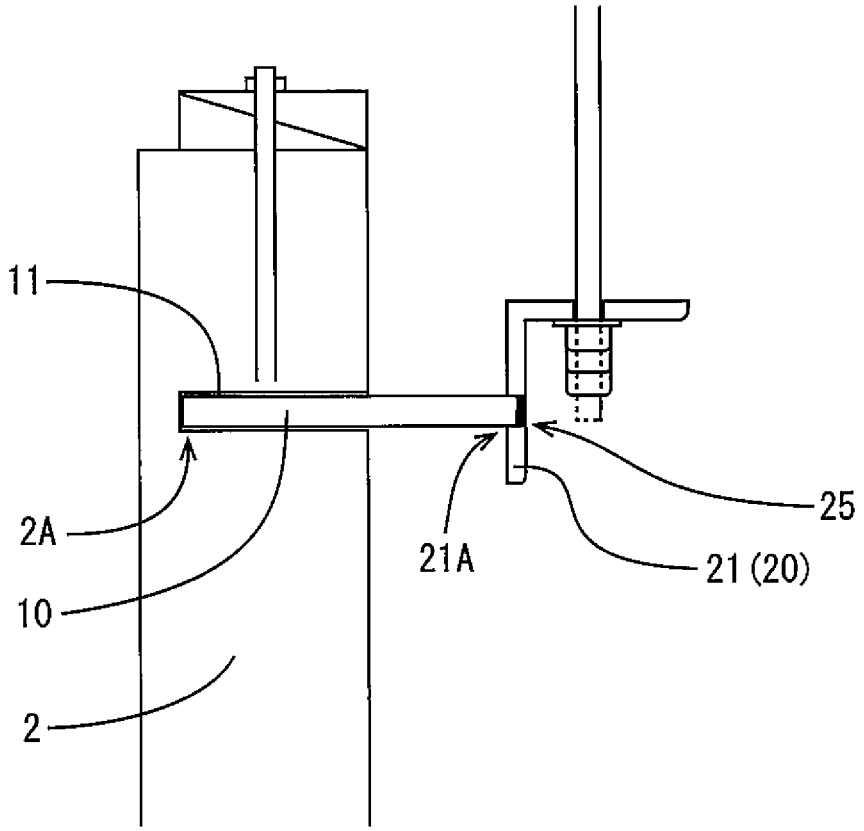
FIG. 9 is a drawing showing a state that the anchor bolt and the fixing member are fixed by welding.

FIG. 9 shows another example of the method of connecting the first anchor bolt 10 and the first fixing member 20. Although the first anchor bolt 10 and the first fixing member 20 are fixed with each other by the nut 23 in the above described embodiment, the first anchor bolt 10 and the first fixing member 20 can be fixed with each other by welding as shown in FIG. 9. The first anchor bolt 10 is fixed to the foundation 2 at one end. The other end of the first anchor bolt 10 is inserted to the middle position in the thickness direction of the first hole 21A formed on the first vertical plate 21. In this state, the other end of the first anchor bolt 10 and the first vertical plate 21 are fixed with each other by welding at the first hole 21A. The portion formed by welding is referred to as a welded portion 25. As shown in FIG. 9, the welded portion 25 fills a space of the remaining half of the first hole 21A. Consequently, the first anchor bolt 10 and the first fixing member 20 can be fixed with each other without using the nuts. Although the explanation is made by using the first anchor bolt 10 and the first fixing member 20 as an example, the same fixing method can be adopted between the second anchor bolt 30 and the second fixing member 40 or between the second anchor bolt 50 and the second fixing member 60.

Figure 10:
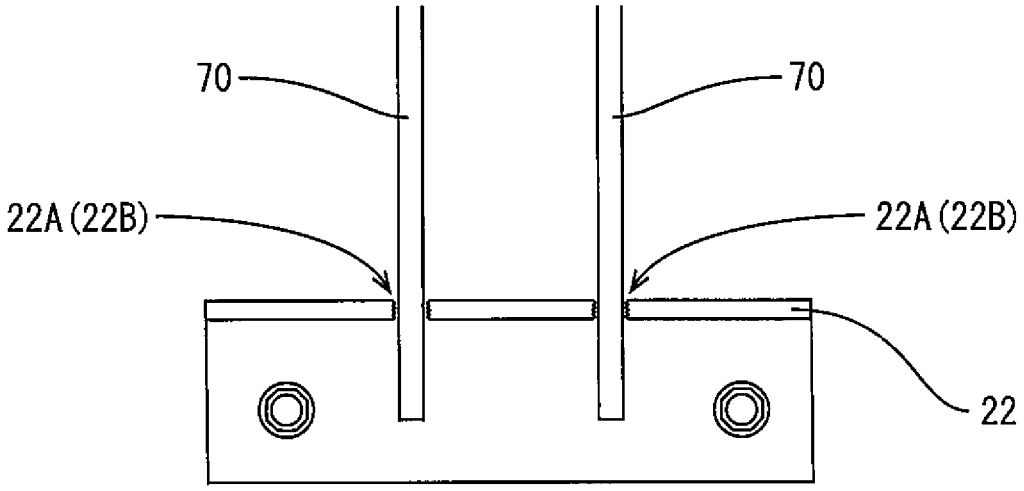
FIG. 10 is a drawing showing a state that the reinforcing steel bar and the fixing member are fixed only by a screw structure.

FIG. 10 shows another example of the method of connecting the reinforcing steel bar 70 and the first fixing member 20. Although the reinforcing steel bar 70 and the first fixing member 20 are fixed with each other by the nut 24 in the above described embodiment, it is also possible to form a thread 22B on an inner periphery of the second hole 22A of the first horizontal plate 22 and screwing the thread formed on the lower end portion of the reinforcing steel bar 70 with thread 22B as shown in FIG. 10. Consequently, the reinforcing steel bar 70 and the first fixing member 20 can be fixed with each other without using the nuts. Although the explanation is made by using the reinforcing steel bar 70 and the first fixing member 20 as an example, the same fixing method can be adopted between the reinforcing steel bar 70 and the second fixing member 40 or between each of the reinforcing steel bar 70, 71 and the second fixing member 60.

Figure 11:
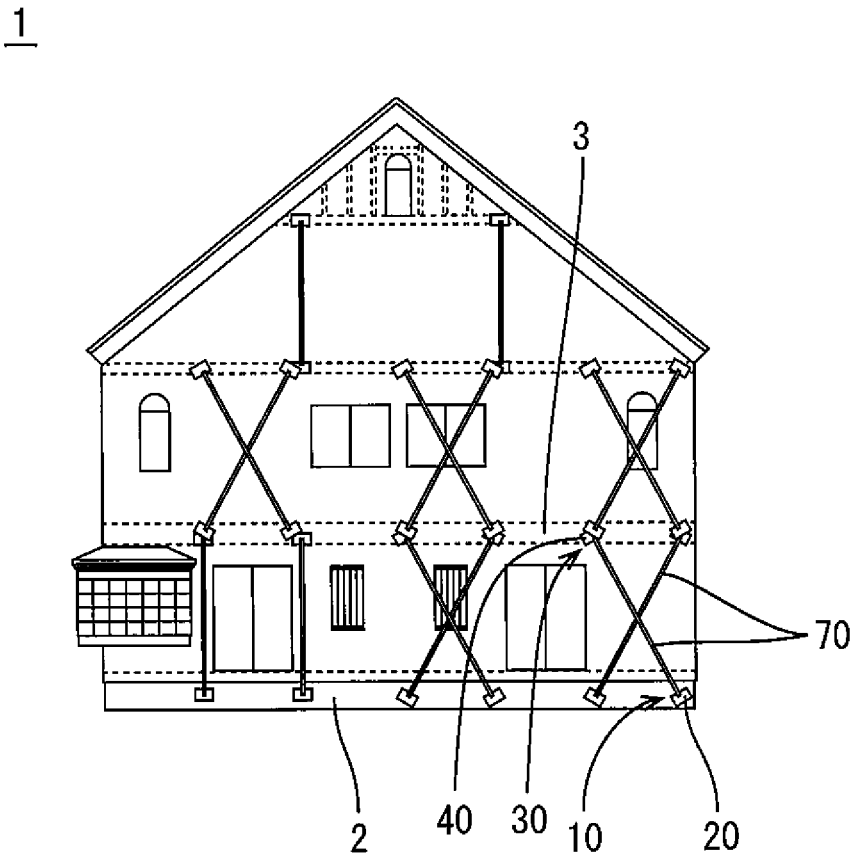
FIG. 11 is a drawing showing a state that the reinforcing structure is attached to the front part of the wooden building.
Figure 12:
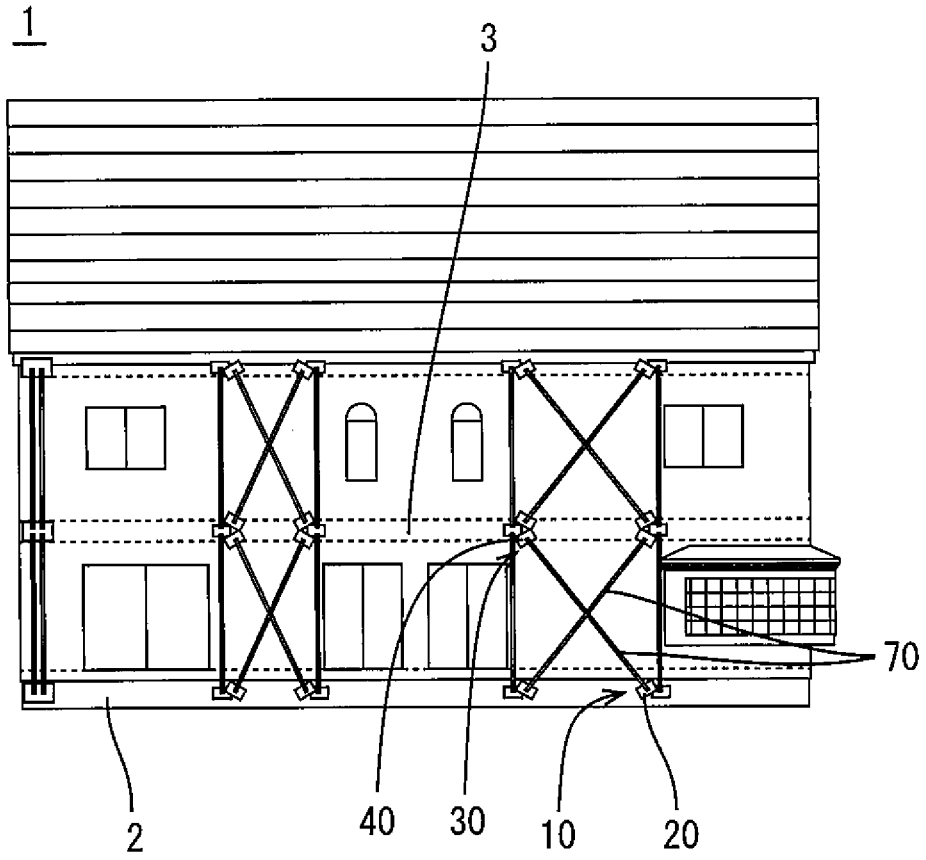
FIG. 12 is a drawing showing a state that the reinforcing structure is attached to the side part of the wooden building.

FIGS. 11 and 12 are another example of the drawing showing a state that the reinforcing structure is attached to the wooden building 1. As shown in FIGS. 11 and 12, the reinforcing steel bar 70 can be inclined obliquely to the vertical direction. Consequently, two reinforcing steel bars 70 can be arranged so as to cross (intersect) each other. In addition, it is not necessary to fix two parallelly arranged reinforcing steel bars with one fixing member as shown in FIGS. 1 and 2. It is also possible to fix one reinforcing steel bar 70 with one fixing member as shown in FIGS. 11 and 12.

Figure 13:
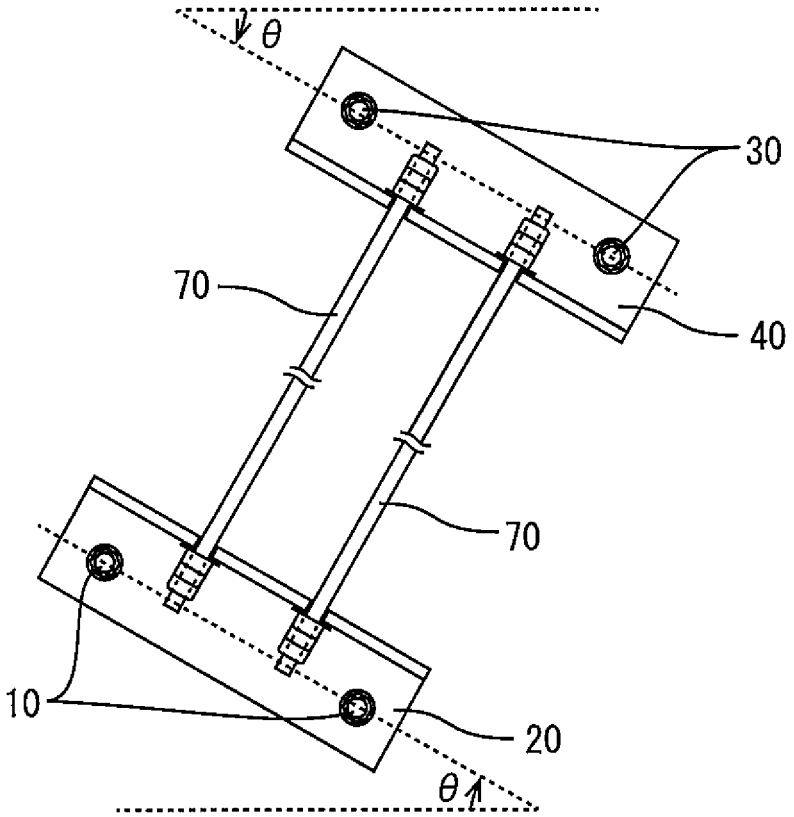
FIG. 13 is a drawing showing a state that the reinforcing steel bar is obliquely arranged.

FIG. 13 is a drawing showing a state that the reinforcing steel bar 70 is obliquely arranged. Hereafter, the explanation is made by using the reinforcing steel bar 70 as an example. However, also the reinforcing steel bar 71 can be obliquely arranged. The components such as the anchor bolt, the fixing member and the reinforcing steel bar to be used are same as the components used when the reinforcing steel bar 70 is vertically arranged. As shown in FIG. 13, the first fixing member 20 is arranged so as to incline with respect to the horizontal direction by a predetermined angle θ in the clockwise direction. In addition, the second fixing member 40 is arranged so as to incline with respect to the horizontal direction by the predetermined angle θ in the clockwise direction. In this state, the reinforcing steel bar 70 is fixed to the first fixing member 20 and the second fixing member 40. Thus, the reinforcing steel bar 70 can be arranged to incline upward with respect to the horizontal direction by the angle (90°−θ).

When the reinforcing steel bar 70 is obliquely arranged, in addition to the force applied in the vertical direction of the wooden building 1, the force applied in other directions can be absorbed by the reinforcing steel bar 70. Namely, the wooden building 1 can be more firmly reinforced by combining the reinforcing steel bars 70 arranged in various directions. Furthermore, even when the reinforcing steel bar 70 cannot be arranged vertically due to the reason of the structure of the wooden building 1, the reinforcement to the vertical force is possible by combining the obliquely arranged reinforcing steel bars 70.

When the obliquely arranged reinforcing steel bars 70 are crossed with each other at an intermediate position as shown in FIGS. 11 and 12, the first fixing member 20 located at the left side is rotated by the predetermined angle θ in the clockwise direction and the first fixing member 20 located at the right side is rotated by the predetermined angle θ in the counterclockwise direction. The second fixing members 40 fixed to the wooden beam 3 are arranged similarly. At this time, in order to prevent the crossing reinforcing steel bars 70 from interfering with each other, the distance D1 (shown in FIG. 3) from the first vertical plate 21 of the first fixing member 20 to the reinforcing steel bar 70 is made different between the fixing member located at the left side and the fixing member located at the right side.

Hereafter, the processes of installing the reinforcing structure of the present invention on the wooden building 1 will be explained. First, the position of arranging the first anchor bolt 10 on the foundation 2 of the wooden building 1 is decided. The bolt hole 2A is formed on the position of arranging the first anchor bolt 10 by using a drill or the like. In addition, the position of arranging the second anchor bolt 30 on the wooden beam 3 of the wooden building 1 is decided at the position above the position of arranging the first anchor bolt 10. The bolt hole 3A is formed on the position of arranging the second anchor bolt 30 by using a drill or the like. When the wooden building 1 is reinforced at three vertical positions, the bolt hole 3A is formed on the wooden beam 3 also at the position of arranging the second anchor bolt 50. The position of arranging the second anchor bolt 50 is located at an intermediate position between the position of arranging the first anchor bolt 10 and the position of arranging the second anchor bolt 30.

After the adhesive agent 11 is inserted into the bolt hole 2A, one end of the first anchor bolt 10 is inserted into the bolt hole 2A. Similarly, after the adhesive agent 31 is inserted into the bolt hole 3A, one end of the second anchor bolt 30 is inserted into the bolt hole 3A. When the second fixing member 60 is used, similarly, one end of the second anchor bolt 50 is inserted into the bolt hole 3A. When the adhesive agent is dried, the anchor bolts are fixed to the bolt holes.

The other end of the first anchor bolt 10 is inserted into the first hole 21A formed on the first vertical plate 21 of the first fixing member 20 and fixed by the nut 23. Similarly, the other end of the second anchor bolt 30 is inserted into the first hole 41A formed on the second vertical plate 41 of the second fixing member 40 and fixed by the nut 43. When the second fixing member 60 is used, the other end of the second anchor bolt 50 is inserted into the first hole 61A formed on the second vertical plate 61 of the second fixing member 60 and fixed by the nut 65. At this time, the first vertical plate 21 and the foundation 2 are separated from each other by a predetermined interval D1 (10 mm-12 mm). Each of the second vertical plates 41, 61 and the wooden beam 3 are also separated from each other by the predetermined interval D1.

The reinforcing steel bar 70 is inserted into the second hole 22A and the second holes 42A, 62A and the reinforcing steel bar 70 is fixed to the first horizontal plate 22 and the second horizontal plates 42, 62, 63 by the nuts 24, 44, 65. By the above described processes, the first anchor bolt 10 fixed to the foundation 2 of the wooden building 1, the second anchor bolt 30, 50 fixed to the wooden beam 3, and the reinforcing steel bar 70 are connected with each other via the first fixing member 20 and the second fixing member 40, 60.

The inventor of the present invention carried out the following experiment for testing the strength against the pulling of the anchor bolt. A columnar wood of Oregon pine having a rectangular cross-section of 150 mm×105 mm was prepared, and bolt holes were formed at the upper and lower parts of the side surface (surface having the width of 150 mm) of the columnar wood. Two bolt holes were formed on each part, the diameter of the bolt holes was 25 mm, and the depth of the bolt holes was 80 mm. Two bolt holes located at the upper part were vertically arranged so as to be separated from each other by a predetermined distance. Two bolt holes located at the lower part were vertically arranged so as to be separated from each other by the predetermined distance. The epoxy resin mortar was inserted into the bolt holes as the adhesive agent, and then the anchor bolts having a diameter of 20 mm were inserted into the bolt holes. Two steel plates having a flat plate-shape and a thickness of 12 mm were prepared. Two holes were formed on each steel plate so as to be separated from each other by the predetermined distance. Two anchor bolts fixed to the bolt holes located at the upper part were inserted into the holes of the first steel plate and fixed to the first steel plate by tightening the nuts from both sides of the first steel plate. Two anchor bolts fixed to the bolt holes located at the lower part were fixed to the second steel plate in the same manner. After the anchor bolts were fixed by the adhesive agent and enough time (approximately three hours) was passed, a wire rope fixed to one of the steel plates was vertically pulled up by a crane in a state that the other of steel plate was fixed to the ground via another wire rope. The load was applied up to 40 KN, but the anchor bolts were not removed from the wood.

From the experiment result described above, it was revealed that remarkably high strength could be obtained against the pulling force when the anchor bolts were fixed on the wood by using the adhesive agent. Of course, it is predicted that similar effect can be obtained when the same structure is applied to the concrete foundation. Namely, even when strong force is applied to the anchor bolts in the direction of pulling the anchor bolts from the wooden building, the anchor bolts can be prevented from removing from the wooden building. Compared to general screws and bolts used in the conventional reinforcing structure of the wooden building, the strength against the force in the pulling direction of the bolts can be increased remarkably.

Hereafter, modified examples of the present invention will be shown. The anchor bolts having a diameter of 20 mm and an entire length of 250 mm are used in the above described embodiment. However, the specification of the anchor bolts to be used is not limited to the above described specification. The anchor bolts having a diameter of approximately 18 mm to 22 mm and having an entire length of approximately 250 mm to 350 mm are preferably used. Other than the above described range, the diameter and the entire length can be arbitrarily selected depending on the part to be used and the reinforcing strength to be required. In addition, the outer diameter and the depth of the bolt holes formed on the foundation and the wooden beam are changed depending on the diameter and the entire length of the anchor bolts.

The epoxy resin mortar is used as the adhesive agent in the above described embodiment. However, the adhesive agent is not limited to the epoxy resin mortar. Other resin adhesives can be used and the adhesive agents other than the resin adhesives can be used. For example, AR chemical setter EX350 manufactured by SANKO TECHNO Co., Ltd. can be used as the adhesive agent.

Two anchor bolts are fixed to one fixing member in the above described embodiment. However, the number of anchor bolts fixed to one fixing member is not limited to two. It is also possible to fix one anchor bolt to one fixing member or to fix three or more anchor bolts to one fixing member.

The angle steel and the channel steel are used as the fixing member in the above described embodiment. However, the fixing member is not limited to the angle steel and the channel steel. Other steel plates having the vertical plate and horizontal plate which are orthogonal to each other can be also used. It is not necessary to integrally form the vertical plate and horizontal plate. It is also possible to separately provide the vertical plate and horizontal plate and fix them with each other so as to be orthogonal to each other. In addition, the fixing member is not necessarily formed by the vertical plate and horizontal plate which are orthogonal to each other. It is enough if the fixing member have two surfaces which are orthogonal to each other. For example, a curved surface can be interposed between the vertical surface and the horizontal surface. In addition, the fixing member is not limited to a plate shape. The fixing member can be a solid block shape. For example, when the fixing member is formed in a square column shape, the anchor bolt and the reinforcing steel bar can be orthogonally arranged by fixing the anchor bolt and the reinforcing steel bar on the neighboring two surfaces of the square column. Furthermore, it is not necessary for the fixing member to have the vertical plate and the horizontal plate or two surfaces which are orthogonal to each other. For example, when the fixing member is formed in a cylindrical shape or a circular column shape, the anchor bolt and the reinforcing steel bar can be orthogonally arranged by fixing the anchor bolt and the reinforcing steel bar on an outer periphery of the cylindrical shape or the circular column shape of the fixing member by displacing the angle by 90°. In addition, the fixing member is not limited to the steel plate. Other metals, woods, and resins can be also used as the fixing member as long as they have enough strength.

The reinforcing steel bar having a diameter of 22 mm is used for the member arranged between two fixing members in the above described embodiment. However, the diameter of the reinforcing steel bar is not limited to 22 mm. In addition, the member arranged between two fixing members is not limited to the reinforcing steel bar. A rod member made of other metals can be used as the member arranged between two fixing members. The members other than metals can be also used as long as they have enough tensile strength. Although the anchor bolts are fixed to the foundation and the wooden beam of the wooden building in the above described embodiment, the position to fix the anchor bolts is not limited to them. The anchor bolts can be fixed to any positions of the wooden building as long as the reinforcing structure has a structure of reinforcing the wooden building by connecting a plurality of positions. The wooden beam is not limited to a joist receiving member. In the present invention, the wooden beam includes all wood materials forming the framework of the wooden building.

Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

DESCRIPTION OF THE REFERENCE NUMERALS

1: wooden building, 2: foundation, 2A: bolt hole, 3: wooden beam, 3A: bolt hole, 10: first anchor bolt, 11: adhesive agent, 20: first fixing member, 21: first vertical plate, 21A: first hole, 22: first horizontal plate, 22A: second hole, 23, 24: nut, 25: welded portion, 30: second anchor bolt, 31: adhesive agent, 40: second fixing member, 41: second vertical plate, 41A: first hole, 42: second horizontal plate, 42A: second hole, 43, 44: nut, 50: second anchor bolt, 60: second fixing member, 61: second vertical plate, 61A: first hole, 62, 63: second horizontal plate, 62A, 63A: second hole, 64, 65: nut, 70, 71: reinforcing steel bar

What is claimed is:

1. A reinforcing structure for a wooden building, comprising:

a first anchor bolt that is horizontally inserted into a concrete foundation of the wooden building and fixed to the concrete foundation by an adhesive agent;

a second anchor bolt that is horizontally inserted into a wooden beam of the wooden building and fixed to the wooden beam by the adhesive agent;

a reinforcing steel bar that is arranged between the first anchor bolt and the second anchor bolt;

a first fixing member that connects and fixes the first anchor bolt and the reinforcing steel bar with each other so that the first anchor bolt and the reinforcing steel bar are orthogonal to each other; and a second fixing member that connects and fixes the second anchor bolt and the reinforcing steel bar with each other so that the second anchor bolt and the reinforcing steel bar are orthogonal to each other.

2. The reinforcing structure for a wooden building according to claim 1, wherein the first fixing member comprises:

a first vertical plate that is fixed to the first anchor bolt so that the first vertical plate is orthogonal to the axial direction of the first anchor bolt; and a first horizontal plate that is integrally formed with the first vertical plate or fixed to the first vertical plate so that the first horizontal plate is orthogonal to the first vertical plate, the second fixing member comprises:

a second vertical plate that is fixed to the second anchor bolt so that the second vertical plate is orthogonal to the axial direction of the second anchor bolt; and a second horizontal plate that is integrally formed with the second vertical plate or fixed to the second vertical plate so that the second horizontal plate is orthogonal to the second vertical plate, and the reinforcing steel bar is fixed to the first horizontal plate and the second horizontal plate.

3. The reinforcing structure for a wooden building according to claim 1, wherein the first fixing member and the concrete foundation are separated from each other by a predetermined interval, and the second fixing member and the wooden beam are separated from each other by the predetermined interval.

4. The reinforcing structure for a wooden building according to claim 2, wherein the first anchor bolt is inserted into a first hole formed on the first vertical plate and fixed to the first vertical plate by a first nut, and the second anchor bolt is inserted into a second hole formed on the second vertical plate and fixed to the second vertical plate by a second nut.

5. The reinforcing structure for a wooden building according to claim 2, wherein the first anchor bolt is inserted into a first hole formed on the first vertical plate and fixed to the first vertical plate by welding, and the second anchor bolt is inserted into a second hole formed on the second vertical plate and fixed to the second vertical plate by welding.

6. The reinforcing structure for a wooden building according to claim 2, wherein the reinforcing steel bar is inserted into a first hole formed on the first horizontal plate and fixed to the first horizontal plate by a first nut, and the reinforcing steel bar is inserted into a second hole formed on the second horizontal plate and fixed to the second horizontal plate by a second nut.

7. The reinforcing structure for a wooden building according to claim 2, wherein the reinforcing steel bar is screwed to a first thread formed in a first hole formed on the first horizontal plate and fixed to the first horizontal plate, and the reinforcing steel bar is screwed to a second thread formed in a second hole formed on the second horizontal plate and fixed to the second horizontal plate.

8. The reinforcing structure for a wooden building according to claim 1, wherein the second anchor bolt is fixed to the wooden beam of a joist receiving member of the wooden building.

* * * * *